US007048650B2

(12) United States Patent
Ichikawa et al.

(10) Patent No.: US 7,048,650 B2
(45) Date of Patent: May 23, 2006

(54) GOLF BALL

(75) Inventors: Yasushi Ichikawa, Chichibu (JP); Rinya Takesue, Chichibu (JP); Eiji Takehana, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 09/732,786

(22) Filed: Dec. 11, 2000

(65) Prior Publication Data

US 2001/0011046 A1 Aug. 2, 2001

(30) Foreign Application Priority Data

Dec. 20, 1999 (JP) ..... 11-361060

(51) Int. Cl.
*A63B 67/00* (2006.01)

(52) U.S. Cl. ..... 473/371; 473/378; 473/365

(58) Field of Classification Search ..... 473/371, 473/772, 374, 354; 524/267
See application file for complete search history.

(56) References Cited

U.S. PATENT DOCUMENTS 4,429,068 A * 1/1984 Nakahira ..... 524/302
4,530,386 A * 7/1985 Nakahira ..... 152/315
5,502,095 A * 3/1996 Ueshima et al. ..... 524/267
5,733,977 A * 3/1998 Takemura et al. ..... 525/105
5,779,561 A * 7/1998 Sullivan et al. ..... 473/373
6,159,110 A * 12/2000 Sullivan et al. ..... 473/374
6,162,134 A * 12/2000 Sullivan et al. ..... 473/354
6,204,331 B1 * 3/2001 Sullivan et al. ..... 473/372
6,270,429 B1 * 8/2001 Sullivan ..... 473/374
6,291,592 B1 * 9/2001 Bulpett et al. ..... 473/354
6,299,551 B1 * 10/2001 Higuchi et al. ..... 473/374
2003/0114252 A1 * 6/2003 Hayashi et al. ..... 473/371
2003/0114253 A1 * 6/2003 Hayashi et al. ..... 473/376
2003/0119607 A1 * 6/2003 Hayashi et al. ..... 473/371
2003/0130060 A1 * 7/2003 Hayashi et al. ..... 473/351

FOREIGN PATENT DOCUMENTS

JP 60-258236 12/1985
JP 8-243191 9/1996
JP 9-220296 8/1997

* cited by examiner

*Primary Examiner*—Glenn Caldarola
*Assistant Examiner*—Tom P. Duong
(74) *Attorney, Agent, or Firm*—Sughrue Mion, PLLC

(57) ABSTRACT

A layer of a golf ball is formed of a golf ball-forming composition in which a silicone rubber powder, silicone resin powder or composite powder thereof is blended in an elastomer, resin or butadiene rubber base. The composition is easy to remove from a mold after molding, and the golf ball has advantages including high durability against consecutive strikes, and good feel and rebound even at low temperature.

16 Claims, 1 Drawing Sheet

GOLF BALL

This invention relates to a golf ball having a portion or layer formed of a golf ball-forming composition which is easy to remove from a mold after molding.

BACKGROUND OF THE INVENTION

In prior art two-piece golf balls, the core is typically formed from rubber materials based on highly resilient polybutadiene rubber and heat crosslinked with a peroxide and a co-crosslinking agent such as methacrylic acid. The cover is commonly formed of ionomer resins featuring impact resistance and cut resistance, commercially available under the trade name of Surlyn and Himilan.

The two-piece golf balls are generally given the advantages of distance and durability at the sacrifice of a soft feel, which is very important to golf players. Efforts were made to develop two-piece golf balls with a soft feel by making the core softer and the cover harder. These golf balls, however, suffer from other problems. Some golf balls are less durable against consecutive strikes, some lack rebound characteristics, and some have poor low-temperature performance.

As a result of the ensuing development work, there were marketed golf balls whose core or cover has a two layer structure in which resilience is assigned to one layer and a feel is assigned to the other layer.

The ionomer resins favored as the cover material and the crosslinked polybutadiene favored as the core material manifest good resilience at a high hardness, but tend to lose resilience as the hardness lowers. While polyurethane elastomers, polyamide elastomers and polyester elastomers are advantageously used as the cover intermediate layer for imparting a comfortable feel, they are desired to have further resilience and the reduced dependency of hardness on temperature.

An attempt was then made to blend millable type silicone rubber in polybutadiene, followed by peroxide crosslinking (JP-A 60-258236). Problems arise with respect to the dispersion of silicone rubber in polybutadiene. Non-uniform reactivity leads to low durability against strikes. This combination is then very difficult to consistently provide good physical properties.

Another attempt was made to blend millable type silicone rubber in a core-forming rubber or cover-forming resin, followed by dynamic crosslinking (JP-A 8-243191 and JP-A 9-220296). These blends have drawbacks including extremely reduced flow, difficulty of injection molding, and difficulty of uniform dispersion, which lead to low durability against strikes. It is very difficult to tailor these blends to a practically acceptable level.

The development of a new material is indispensable to impart desirable characteristics to the golf ball. In the golf ball industry, there is a need for a material having further increased resilience to enable better flight performance, softness, and stable physical properties over a wide temperature range.

SUMMARY OF THE INVENTION

An object of the invention is to provide a golf ball formed of a material which is easy to mold and maintains stable softness and high resilience over a wide temperature range.

According to the invention, there is provided a golf ball comprising a portion formed of a golf ball-forming composition having blended therein at least one of a silicone rubber powder, a silicone resin powder, and a composite powder thereof.

Preferably, the composite powder comprises silicone rubber particles surface coated with a silicone resin; the silicone rubber powder comprises crosslinked dimethylpoly-siloxane and/or methylphenylpolysiloxane microparticulates; the silicone resin powder comprises cured polyorganosilsesquioxane microparticulates. Typically the silicone rubber powder, silicone resin powder, and composite powder are of spherical particles and have a particle size of 0.5 to 50 μm and a particle size distribution ranging from 0.1 to 100 μm. The silicone rubber powder, silicone resin powder, and composite powder have functional groups borne thereon. The silicone rubber powder, silicone resin powder, and composite powder thereof are preferably blended in an amount of 0.5 to 50% by weight of the composition.

The golf ball-forming composition is typically at least one member selected from among a one-piece golf ball material, a core material and a cover material for a two-piece golf ball, a core material, an intermediate layer material and a cover material for a multi-piece golf ball having at least three pieces.

In one preferred embodiment, the golf ball-forming composition is based on at least one member selected from among an ethylene ionomer resin, polyester elastomer, polyurethane elastomer, polyolefin elastomer, polyamide elastomer, polyolefin resin, and styrene block copolymer. The preferred ethylene ionomer resin is an ethylene-(meth) acrylic acid copolymer neutralized with a monovalent and/or divalent metal ion or an ethylene-(meth)acrylic acid-(meth) acrylate terpolymer neutralized with a metal ion. The ethylene ionomer resin preferably has a Shore D hardness of 40 to 80 and a (meth)acrylic acid content of 5 to 25% by weight.

In another preferred embodiment, the golf ball-forming composition is based on a rubber material comprising a polybutadiene containing at least 40% of cis-1,4 bonds and an unsaturated carboxylic acid or metal ion or both for crosslinking the polybutadiene.

We have found that by blending an appropriate amount of a fine powder of polysiloxane structure such as a silicone rubber powder, silicone resin powder or composite powder thereof in a golf ball-forming composition, more specifically by blending a silicone powder in the cured state from the first rather than crosslinking a millable type silicone rubber with a golf ball-forming material as in the prior art, the composition is significantly improved in mold release necessary to enable in-mold shaping and injection molding. In addition, a golf ball formed therefrom is improved in flight performance and durability against consecutive strikes and offers a very soft feel when hit.

When a silicone rubber powder, silicone resin powder or composite powder thereof is blended in a golf ball-forming composition (e.g., a material to form the center, core, cover, cover layer or one-piece golf ball), preferably in an amount of 0.5 to 50% by weight based on the composition, a golf ball formed therefrom is given excellent moldability, resilience and low-temperature properties which have never been achieved with conventional golf ball materials. That is, the golf ball has improved flight performance and durability against consecutive strikes as well as a very soft feel when hit. The invention is predicated on these findings.

DESCRIPTION OF THE PREFERRED EMBODIMENT

Figure 1:
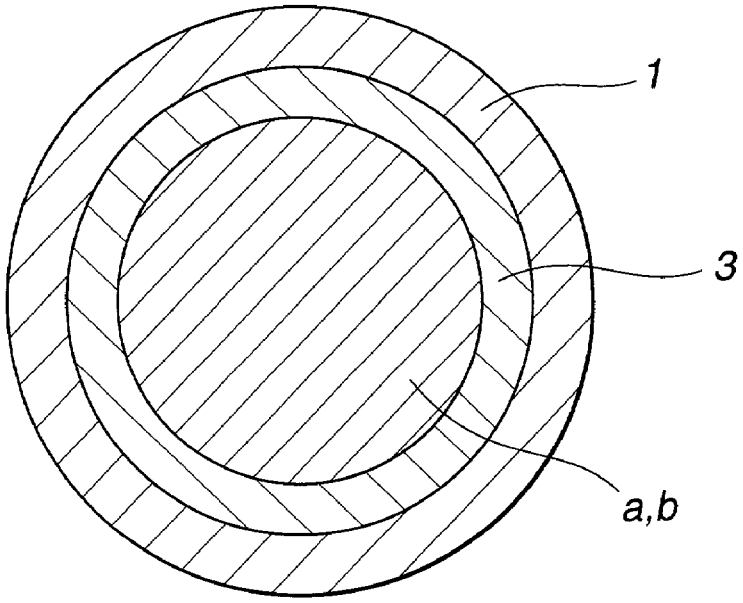
FIG. 1 is a schematic view of a three-piece golf ball according to one embodiment of the invention.

The golf ball of the invention requires that at least one powder in the cured state selected from among a silicone rubber powder, a silicone resin powder, and a composite powder thereof be blended in a golf ball-forming composition.

The silicone rubber powder used herein is, for example, a microparticulate product of high polymeric stereostructure obtained by crosslinking a linear dimethylpolysiloxane and/or methylphenylpolysiloxane having at least 0.05 mol % of vinyl groups added thereto with methylhydrogenpolysiloxane as a crosslinking agent, or a modified one thereof. The silicone rubber powder preferably has a true specific gravity of approximately 0.97. Suitable powder in spherical particle form is commercially available, for example, under the trade name of KMP597, 598, 594 and 595 and in irregular particle form under the trade name of X-52-875, all from Shin-Etsu Chemical Co., Ltd.

The silicone resin powder used herein is, for example, a microparticulate cured polyorganosilsesquioxane in which siloxane bonds are cured to form a three-dimensional network represented by $(RSiO_{3/2})_n$, or a modified one thereof. It is recommended that R in the formula be $CH_3$, $C_6H_5$ or long-chain alkyl. The silicone resin powder preferably has a true specific gravity of approximately 1.3. Suitable powder in spherical particle form is commercially available, for example, under the trade name of KMP590, X-52-1186 and X-52-854 from Shin-Etsu Chemical Co., Ltd. Suitable powder of the type modified with vinyl, epoxy and amino groups are available under the trade name of X-52-821, X-52-830 and X-52-831, from Shin-Etsu Chemical Co., Ltd.

The composite silicone powder used herein comprises silicone rubber particles which are surface coated with a silicone resin, both the silicone rubber and the silicone resin being as described above. The composite silicone powder preferably has a true specific gravity of 1.0 to 0.98. Suitable powder is commercially available, for example, under the trade name of KMP600 and X-52-1139G from Shin-Etsu Chemical Co., Ltd.

Whether it is silicone rubber, silicone resin or composite silicone type, the silicone powder used herein may be either a powder of spherical particles or a powder of irregular particles, with the spherical particle powder being preferred.

It is very easy to add the silicone powder to rubbers or resins which are conventionally used as the base of golf ball-forming materials because the silicone particles are effectively dispersible therein. For further improved compatibility with rubbers or resins, a silicone powder bearing functional groups such as vinyl, epoxy and amino groups is advantageously used.

The silicone powder preferably has a mean particle size of at least 0.5 μm, more preferably at least 0.6 μm, further preferably at least 2 μm, and up to 50 μm, more preferably up to 30 μm, further preferably up to 15 μm, most preferably up to 6 μm. A powder with too small a mean particle size may scatter in the dispersion step and be awkward to the manufacture whereas a powder with too large a mean particle size may be poorly dispersible and ineffective for improving durability against strikes.

Also preferably, the silicone powder has a particle size distribution ranging from 0.1 μm, more preferably from 1 μm, to 100 μm, more preferably to 30 μm, further preferably to 15 μm, most preferably to 10 μm. A narrower particle size distribution ensures more uniform dispersion.

The golf ball of the invention should include at least one constituent layer having the silicone powder blended therein. Specifically, at least one constituent layer is formed of a golf ball-forming composition having an appropriate amount of the silicone powder blended therein.

Independent of the type of the silicone powder and the type of base polymer of the composition, an appropriate amount of the silicone powder blended is at least 0.5%, especially at least 5% by weight and up to 50%, especially up to 30% by weight based on the weight of the base polymer (or golf ball-forming composition). Beyond the upper limit, uniform dispersion may become difficult, resulting in losses of resilience and durability against consecutive strikes. Below the lower limit, the addition effect of the silicone powder may become unascertainable.

While at least one constituent layer of a golf ball is formed of a golf ball-forming composition having the silicone powder blended therein, the golf ball-forming composition may be any of well-known compositions used in golf balls, for example, compositions based on rubbers or thermoplastic resins for the center of wound golf balls, rubbers or thermoplastic resins for the core or core layer of solid golf balls, rubbers or thermoplastic resins for the outermost layer (cover) or inner layer of wound golf balls or solid golf balls.

Illustrative examples of the base polymer in the golf ball-forming composition include polybutadiene containing at least 40% of cis-1,4 bonds, styrene block copolymers, polyurethane elastomers, polyester elastomers, polyamide elastomers, polyolefin elastomers, polyolefin resins, and ethylene ionomer resins.

The polybutadiene exemplified as the base of a rubber composition is one containing at least 40% of cis-1,4 bonds, preferably at least 70% of cis-1,4 bonds. Suitable polybutadiene may be selected from well-known ones, for example, BROL from JSR. The polybutadiene is typically used as materials to form the solid center of wound golf balls and the core and inner layer (excluding outer layer or cover) of solid golf balls. The polybutadiene containing at least 40% of cis-1,4 bonds is advantageously used as the materials to form the solid center of wound golf balls and the core of solid golf balls. Where polybutadiene containing at least 40% of cis-1,4 bonds is blended in the golf ball-forming composition, a carboxylic acid and/or metal ion-containing compound is preferably used for crosslinking purposes. Suitable compounds are zinc oxide and magnesium stearate.

The styrene block copolymers used herein include styrene-butadiene-styrene block copolymers (SB and SBS), styrene-isoprene-styrene block copolymers (SI and SIS), and hydrogenated products thereof (SEB, SEBS, SEP, SEPS). They are commercially available under the trade name of Califlex TR and Kraton G from Shell Chemical and Septon from Kurare K.K.

The polyurethane elastomers used herein include well-known thermoplastic and thermosetting polyurethane elastomers. A commercially available example is Pandex from Dainippon Ink Chemical K.K.

The polyester elastomers used herein include well-known thermoplastic polyester elastomers. A commercially available example is Hytrel from Dupont-Toray K.K.

The polyamide elastomers used herein include well-known thermoplastic polyamide elastomers. A commercially available example is Pebax from Toray K.K.

The polyolefin elastomers used herein include well-known dynamic crosslinking polyolefin elastomers. They are commercially available under the trade name of Santoprene from Monsanto Co. and Dynalon (hydrogenated polybutadiene) from JSR.

The polyolefin resins used herein include linear low-density polyethylene, ethylene-(meth)acrylic acid copolymers, and ethylene-(meth)acrylic acid-(meth)acrylate copolymers.

The ethylene ionomer resins used herein include copolymers of α-olefin and α,β-unsaturated carboxylic acid in which carboxyl groups are neutralized with mono- or divalent metal ions; and copolymers of α-olefin, α,β-unsaturated carboxylic acid and α,β-unsaturated carboxylate in which carboxyl groups are neutralized with mono- or divalent metal ions.

Examples of the α-olefin include those of 2 to 8 carbon atoms, especially 2 to 6 carbon atoms. Exemplary α,β-unsaturated carboxylic acids are acrylic acid, methacrylic acid, maleic acid, and fumaric acid. The α,β-unsaturated carboxylates include esters of about 4 to 12 carbon atoms, for example, methyl (meth)acrylate, ethyl (meth)acrylate, isobutyl (meth)acrylate, n-butyl (meth)acrylate, and 2-ethylhexyl (meth)acrylate, with isobutyl (meth)acrylate being most preferred.

An appropriate acid content is 5 to 25%, more preferably 7 to 20%, most preferably 10 to 15% by weight based on the entire weight of the ionomer resin. An ionomer resin with too low an acid content may be less resilient whereas an ionomer resin with too high an acid content may be less flexible. The content of (meth)acrylate is preferably at least 5%, more preferably at least 8% by weight, and up to 45%, more preferably up to 30% by weight based on the entire weight of the ionomer resin. Too low a (meth)acrylate content may make it difficult to form a fully flexible composition whereas too high a (meth)acrylate content may give a composition which is too flexible to provide cutting resistance.

Exemplary metal ions used for neutralization in the ionomer resins are Na, Li, Zn, Mg, K and Ca. The degree of neutralization is usually at least 10 mol %, more preferably at least 30 mol % while its upper limit is up to 90 mol %, especially up to 80 mol %. Too low a degree of neutralization may lead to the lack of resilience whereas too high a degree of neutralization may interfere with the flow during molding.

The ethylene ionomer resin preferably has a Shore D hardness of 40 to 80, more preferably 45 to 75.

Suitable ionomer resins are commercially available under the trade name of Himilan from Dupont-Mitsui Polychemical K.K., Surlyn from E. I. Dupont and Iotek from Exxon Corp.

In the practice of the invention, the ethylene ionomer resin and olefin resin are advantageously used as a material to form the inner layer and outer layer (cover) in three or more layer structure golf balls, and especially as the cover material.

The polyester elastomer, polyurethane elastomer, polyolefin elastomer, polyamide elastomer, polyolefin resin and styrene block copolymer should preferably have a Shore D hardness of at least 10, more preferably at least 20, while its upper limit is preferably up to 50, especially up to 40. A resin material having a hardness within this range is advantageously used as a material to form the solid center of wound golf balls, the core of solid golf balls, and the inner layer of three or more layer structure golf balls, and especially as the inner layer material.

Depending on the particular portion of the golf ball which is formed of the composition, suitable additives can be blended in the above-described base polymer. Exemplary additives are pigments, dispersants, antioxidants, and UV absorbers and added in customary amounts. Additionally, inert fillers such as zinc oxide, barium sulfate, titanium dioxide, silica, calcium carbonate and zinc carbonate; polyethylene wax and metal soaps may also be added for the purposes of specific gravity adjustment in accordance with the standards of golf ball as well as coloring.

According to the invention, the silicone powder is blended in the golf ball-forming composition described above. An appropriate compounding method is selected from well-known methods for compounding golf ball-forming materials. For example, when the silicone powder is blended in polybutadiene rubber, a mixer commonly used for rubber, typically a Banbury mixer or roll mill is employed. Where the silicone powder is blended in the thermoplastic resin, a mixer commonly used for resins, typically a single or twin-screw extruder or roll mill is employed.

The core, intermediate layer or outer layer can be formed by any of methods commonly used in conventional golf ball molding. In a core molding example using polybutadiene rubber, the rubber composition is compression or injection molded in a core-forming mold where the composition is heat cured by heating at a sufficient temperature for the crosslinking agent and co-crosslinking agent to act (e.g., at about 130 to 170° C. for 5 to 40 minutes when the crosslinking agent and co-crosslinking agent are dicumyl peroxide and zinc acrylate, respectively). The core is formed in this way.

When the intermediate layer and outer layer (cover) are molded from the thermoplastic resin, any of methods commonly used in conventional golf ball molding is acceptable. For example, the core prepared by the above method is placed in a mold, in which the thermoplastic resin composition is compression or injection molded so as to enclose the core.

The shape of the respective layers thus formed is not critical. Often, the core preferably has a diameter of at least 25 mm, especially at least 27 mm and up to 42 mm, especially up to 40 mm. The solid center preferably has a diameter of at least 15 mm, especially at least 20 mm and up to 40 mm, especially up to 38 mm. With a core or center diameter outside the range, resilience and/or durability against consecutive strikes may become insufficient. The one-piece solid golf ball preferably has a diameter of 40 mm to 43 mm so that it may have an approximate outer diameter as the authorized golf ball.

In the event where the golf ball-forming composition is used in wound golf balls, the composition is advantageously used to form the solid center, intermediate layer or cover (enclosing the thread rubber layer). The wound golf ball includes a wound core in the form of a solid or liquid center on which thread rubber is wound. The wound core is manufactured by any well-known method, usually by winding thread rubber around the center. The thread rubber layer thus formed preferably has a thickness of at least 1 mm, especially at least 1.5 mm and up to 4.4 mm, especially up to 4.0 mm. Outside the range, a loss of resilience or a loss of durability against consecutive strikes may become noticeable.

Where the intermediate layer or outer layer of multi-piece golf balls is formed from the golf ball-forming composition according to the invention, that layer should preferably have a thickness of at least 0.5 mm, especially at least 1 mm and up to 3 mm, especially up to 2.5 mm. Outside the range, a loss of resilience or a loss of durability against consecutive strikes may become noticeable. The intermediate layer or outer layer should preferably have a Shore D hardness of from 15 to 80, more preferably from 25 to 70. Specifically the intermediate layer (or inner layer) should preferably have a Shore D hardness of from 20 to 75, more preferably from 30 to 60; and the outer layer (cover) should preferably have a Shore D hardness of from 40 to 80, more preferably from 45 to 65. Outside the range, a loss of resilience, a loss of durability against consecutive strikes or degradation of feel may become noticeable.

The golf ball is formed with a plurality of dimples on its surface. The geometrical arrangement of dimples may be octagonal or icosahedral arrangement while the dimple pattern may be any of square, hexagon, pentagon and triangle patterns.

The diameter and weight of the golf ball are set in accordance with the Rules of Golf, specifically to a diameter of not less than 42.67 mm and a weight of not greater than 45.93 grams.

EXAMPLE

Examples of the invention are given below by way of illustration and not by way of limitation. All parts are by weight.

Figure 2:
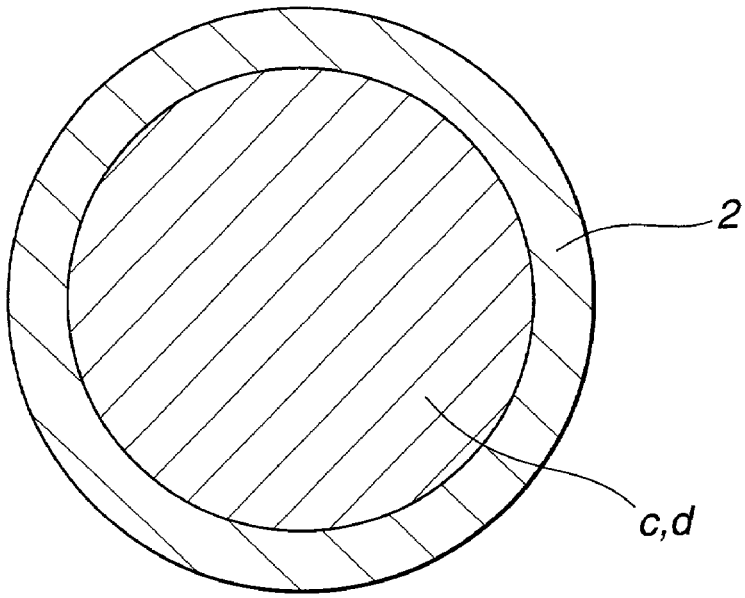
FIG. 2 is a schematic view of a two-piece golf ball according to another embodiment of the invention.

Referring to FIGS. 1 and 2, there are illustrated three and two-piece golf balls which were prepared in the Examples. The three-piece golf ball shown in FIG. 1 include a core (a) or (b), an intermediate layer 3, and an outer layer 1. The two-piece golf ball shown in FIG. 2 include a core (c) or (d) and an outer layer 1. All the layers are disposed in a concentric fashion so that a radially outside layer encloses a radially inside layer.

Core-forming compositions were formulated in accordance with Table 1, milled in a Banbury mixer and conventionally molded at 155° C. for 15 minutes, forming cores. It is noted that the core (d) in Table 1 was obtained by premixing 10 parts of silicone rubber TSE 2287U with 0.5 part of peroxide TC-8 on a roll mill and compounding the premix with the remaining components.

The components in Tables 1 to 3 are shown below.

BROL: polybutadiene rubber by JSR

Hytrel 3046: polyester elastomer, Shore D hardness 30, by Dupont-Toray K.K.

Hytrel 4047: polyester elastomer, Shore D hardness 40, by Dupont-Toray K.K.

Himilan 1706: Zn-neutralized ionomer resin, acid content 15%, Shore D hardness 62, by Dupont-Mitsui Polychemical K.K.

Himilan 1605: Na-neutralized ionomer resin, acid content 15%, Shore D hardness 62, by Dupont-Mitsui Polychemical K.K.

Himilan AM7318: Na-neutralized ionomer resin, acid content 18%, Shore D hardness 65, by Dupont-Mitsui Polychemical K.K.

Himilan AM7317: Zn-neutralized ionomer resin, acid content 18%, Shore D hardness 65, by Dupont-Mitsui Polychemical K.K.

Himilan 1601: Na-neutralized ionomer resin, acid content 10%, Shore D hardness 60, by Dupont-Mitsui Polychemical K.K.

Himilan 1557: Zn-neutralized ionomer resin, acid content 12%, Shore D hardness 58, by Dupont-Mitsui Polychemical K.K.

TSE 2287U: millable type silicone rubber, JIS-A hardness 80, by Toshiba Silicone K.K.

TC-8: 2,5-dimethyl-2,5-di(tert-butylperoxy)hexane 50% paste, by Toshiba Silicone K.K.

KMP597: silicone rubber powder, spherical, mean particle size 5 μm, particle size distribution 1-10 μm, true specific gravity 0.97, water content 0.1%, by Shin-Etsu Chemical Co., Ltd.

X-52-830: silicone resin powder, spherical, mean particle size 2 μm, particle size distribution 1-8 μm, true specific gravity 1.3, water content 1%, epoxy group introduced, by Shin-Etsu Chemical Co., Ltd.

KMP600: composite silicone powder, spherical, mean particle size 5 μm, particle size distribution 1–15 μm, true specific gravity 1.00, water content 0.1%, by Shin-Etsu Chemical Co., Ltd.

XER-91: carboxyl group-modified, crosslinked rubber (NBR) particles, mean particle size 0.07 μm, by JSR IM-301: carboxyl group-modified acrylic monomer "core/shell polymer," mean particle size 0.1–0.7 μm, by Takeda Pharmaceutical K.K.

TABLE 1

| | | (a) | (b) | (c) | (d) |
|---|---|---|---|---|---|
| Core Formulation (pbw) | Polybutadiene BR01 | 100 | 100 | 100 | 90 |
| | Zinc diacrylate | 25 | 25 | 26 | 26 |
| | Dicumyl peroxide | 1.2 | 1.2 | 1.2 | 1.2 |
| | Zinc oxide | 5 | 5 | 5 | 5 |
| | Barium sulfate | 21.5 | 21.5 | 17.0 | 17.0 |
| | Antioxidant | 0.2 | 0.2 | 0.2 | 0.2 |
| | Peptizer | 0.1 | 0.1 | 0.1 | 0.1 |
| | KMP 597 | | 10 | | |
| | TSE 2287U (TC-8) | | | | 10 |
| Physical properties | Diameter (mm) | 35.2 | 35.2 | 38.7 | 38.7 |
| | Hardness (mm) | 3.9 | 3.9 | 3.1 | 3.1 |
| | Weight (g) | 27.1 | 27.5 | 35.6 | 35.9 |
| | Initial velocity @ 23° C. (m/s) | 76.55 | 76.65 | 76.55 | 76.30 |

Intermediate and outer layer-forming resin compositions were blended in accordance with Tables 2 and 3 and compounded on a twin-screw extruder.

As noted above, the core (d) of Comparative Example 6 was prepared by compounding polybutadiene with millable type silicone rubber, and molding the compound concomitant with crosslinking and curing.

The intermediate layer of Comparative Example 7 was prepared from millable type silicone rubber by compounding 100 parts of TSE 2287U with 0.5 part of TC-8, sheeting the compound, wrapping the pre-formed core with the sheets, effecting primary vulcanization at 170° C. for 10 minutes in a core-molding press, taking out the core, and effecting secondary vulcanization at 200° C. for 4 hours. The resulting core is the silicone intermediate layer-bearing core.

On the cores, covers or outer layers were molded as shown in Tables 2 and 3, obtaining golf balls.

The golf balls were tested as follows, with the results also shown in Tables 2 and 3. Many measurements were made both at room temperature (23° C.) and at a low temperature (3° C.).

Hardness is a deflection (mm) under an applied load of 100 kg.

Initial velocity was measured at 23° C. and 3° C. on apparatus approved by USGA.

Flight distance (including carry and total) was determined at 23° C. and 3° C. by hitting the ball with a driver (#1W) at a head speed (HS) of 45 m/s using a hitting machine by True Temper Co.

Slope is the slope of a correlation line between initial velocities at 23° C. and 3° C.

Durability against strikes was determined by repeatedly hitting the ball with a driver (#1W) at a head speed of 40 m/s using a hitting machine by True Temper Co., with the maximum being 300 strikes. In each example, five balls were tested. The number of broken balls and an average of the strikes at which the balls were broken are reported.

Feel was rated at 23° C. and 3° C. by five low-handicap amateur golfers using a driver, No. 5 iron and putter.

VS: very soft and pleasant

S: soft and good

Av: ordinary

H: hard

TABLE 2

| | Example | | | | | | |
|---|---|---|---|---|---|---|---|
| | 1 | 2 | 3 | 4 | 5 | 6 | 7 |
| Material (pbw) | | | | | | | |
| Core (Table 1) | a | a | a | a | a | c | b |
| Intermediate Layer | | | | | | | |
| Hytrel 4047 | 100 | 100 | 100 | 100 | | | 100 |
| Hytrel 3046 | | | | | 100 | | |
| X-52-830 | | | | | 5 | | |
| Cover or outer layer | | | | | | | |
| Himilan 1706 | 50 | | 50 | 50 | 50 | 50 | 50 |
| Himilan 1605 | 50 | | 50 | 50 | 50 | 50 | 50 |
| Himilan AM7318 | | 50 | | | | | |
| Himilan AM7317 | | 50 | | | | | |
| KMP597 | 10 | 10 | | | | 10 | |
| X-52-830 | | | 5 | | | | |
| KMP600 | | | | 10 | | | |
| Titanium dioxide | 3 | 3 | 3 | 3 | 3 | 3 | 3 |
| Structure | | | | | | | |
| Core | | | | | | | |
| Diameter (mm) | 35.2 | 35.2 | 35.2 | 35.2 | 35.2 | 38.7 | 35.2 |
| Hardness (mm) | 3.9 | 3.9 | 3.9 | 3.9 | 3.9 | 3.3 | 3.9 |
| Weight (g) | 27.1 | 27.1 | 27.1 | 27.1 | 27.1 | 35.6 | 27.5 |
| Initial Velocity @ 23° C. (m/s) | 76.55 | 76.55 | 76.55 | 76.55 | 76.55 | 76.55 | 76.65 |
| Intermediate layer | | | | | | | |
| Outer diameter (mm) | 38.7 | 38.7 | 38.7 | 38.7 | 38.7 | — | 38.7 |
| Hardness (mm) | 3.7 | 3.7 | 3.7 | 3.7 | 3.7 | — | 3.7 |
| Weight (g) | 35.6 | 35.6 | 35.6 | 35.6 | 35.6 | — | 35.8 |
| Initial velocity @ 23° C. (m/s) | 75.76 | 75.76 | 75.76 | 75.76 | 75.92 | — | 75.95 |
| Ball (after outer layer molding and painting) | | | | | | | |
| Diameter (mm) | 42.7 | 42.7 | 42.7 | 42.7 | 42.7 | 42.7 | 42.7 |
| Hardness (mm) | 3.3 | 3.0 | 3.2 | 3.3 | 3.0 | 3.3 | 3.0 |
| Weight (g) | 45.2 | 45.2 | 45.2 | 45.2 | 45.2 | 45.2 | 45.5 |
| Initial Velocity @ 23° C. (m/s) | 76.84 | 77.15 | 76.70 | 76.77 | 76.92 | 76.81 | 77.06 |
| Initial Velocity @ 3° C. (m/s) | 75.96 | 76.26 | 75.77 | 75.88 | 76.02 | 75.93 | 76.18 |
| Slope | 0.0440 | 0.0445 | 0.0465 | 0.0445 | 0.0450 | 0.0440 | 0.0440 |
| Flight performance | | | | | | | |
| Distance @ 23° C., HS 45 | | | | | | | |
| Carry (m) | 218.6 | 220.0 | 218.0 | 218.5 | 219.0 | 218.5 | 219.5 |
| Total (m) | 233.5 | 235.0 | 233.0 | 233.0 | 233.5 | 233.2 | 234.0 |
| Distance @ 3° C., HS 45 | | | | | | | |
| Carry (m) | 213.5 | 214.5 | 212.0 | 213.0 | 213.5 | 213.4 | 214.0 |
| Total (m) | 227.7 | 230.1 | 227.3 | 228.2 | 228.1 | 227.5 | 228.8 |
| Durability against strikes | | | | | | | |
| Number of broken balls/test balls | 0/5 | 0/5 | 0/5 | 0/5 | 0/5 | 0/5 | 0/5 |
| Average of strikes at breakage (300 strikes at maximum) | not broken | not broken | not broken | not broken | not broken | not broken | not broken |

TABLE 2-continued

| | Example | | | | | | |
|---|---|---|---|---|---|---|---|
| | 1 | 2 | 3 | 4 | 5 | 6 | 7 |
| Feel @ 23° C. | | | | | | | |
| Putter | VS | VS | VS | VS | S | VS | S |
| Iron | VS | VS | VS | VS | VS | VS | VS |
| Driver | VS | VS | S | VS | VS | VS | VS |
| Feel @ 3° C. | | | | | | | |
| Putter | VS | VS | VS | VS | VS | VS | VS |
| Iron | VS | VS | VS | VS | VS | VS | VS |
| Driver | VS | VS | VS | VS | VS | VS | VS |

TABLE 3

| | Example | | | | | | |
|---|---|---|---|---|---|---|---|
| | 1 | 2 | 3 | 4 | 5 | 6 | 7 |
| Material (pbw) | | | | | | | |
| Core (Table 1) | a | a | a | a | c | d | a |
| Intermediate Layer | | | | | | | |
| Hytrel 4047 | 100 | 100 | 100 | 100 | | | |
| TSE 2287U | | | | | | | 100 |
| Cover or outer layer | | | | | | | |
| Himilan 1706 | 50 | | 50 | 50 | 50 | 50 | 50 |
| Himilan 1605 | 50 | | 50 | 50 | 50 | 50 | 50 |
| Himilan 1601 | | 50 | | | | | |
| Himilan 1557 | | 50 | | | | | |
| XER-91 | | | 10 | | | | |
| IM-301 | | | | 10 | | | |
| Titanium dioxide | 3 | 3 | 3 | 3 | 3 | 3 | 3 |
| Structure | | | | | | | |
| Core | | | | | | | |
| Diameter (mm) | 35.2 | 35.2 | 35.2 | 35.2 | 38.7 | 38.7 | 35.2 |
| Hardness (mm) | 3.9 | 3.9 | 3.9 | 3.9 | 3.3 | 3.3 | 3.9 |
| Weight (g) | 27.1 | 27.1 | 27.1 | 27.1 | 35.6 | 35.9 | 27.1 |
| Initial Velocity @ 23° C. (m/s) | 76.55 | 76.55 | 76.55 | 76.55 | 76.55 | 76.30 | 76.35 |
| Intermediate layer | | | | | | | |
| Outer diameter (mm) | 38.7 | 38.7 | 38.7 | 38.7 | — | — | 38.7 |
| Hardness (mm) | 3.7 | 3.7 | 3.7 | 3.7 | — | — | 3.7 |
| Weight (g) | 35.6 | 35.6 | 35.6 | 35.6 | — | — | 35.8 |
| Initial velocity @ 23° C. (m/s) | 75.73 | 75.73 | 75.73 | 75.73 | — | — | 75.33 |
| Ball (after outer layer molding and painting) | | | | | | | |
| Diameter (mm) | 42.7 | 42.7 | 42.7 | 42.7 | 42.7 | 42.7 | 42.7 |
| Hardness (mm) | 3.0 | 3.1 | 3.3 | 3.3 | 3.0 | 3.0 | 3.0 |
| Weight (g) | 45.2 | 45.2 | 45.2 | 45.2 | 45.2 | 45.5 | 45.3 |
| Initial Velocity @ 23° C. (m/s) | 76.58 | 76.22 | 76.65 | 76.58 | 76.71 | 76.50 | 76.32 |
| Initial Velocity @ 3° C. (m/s) | 75.43 | 75.16 | 75.52 | 75.48 | 75.55 | 75.55 | 75.41 |
| Slope | 0.0575 | 0.0530 | 0.0565 | 0.0550 | 0.0580 | 0.0475 | 0.0455 |
| Flight performance | | | | | | | |
| Distance @ 23° C., HS 45 | | | | | | | |
| Carry (m) | 217.0 | 214.4 | 217.5 | 216.5 | 217.5 | 216.5 | 215.0 |
| Total (m) | 232.0 | 229.5 | 231.8 | 231.2 | 232.0 | 231.5 | 230.0 |

TABLE 3-continued

| | Example | | | | | | |
|---|---|---|---|---|---|---|---|
| | 1 | 2 | 3 | 4 | 5 | 6 | 7 |
| Distance @ 3° C., HS 45 | | | | | | | |
| Carry (m) | 209.0 | 207.0 | 210.0 | 209.5 | 210.5 | 208.5 | 209.0 |
| Total (m) | 224.5 | 221.0 | 224.2 | 223.2 | 224.3 | 223.9 | 222.8 |
| Durability against strikes | | | | | | | |
| Number of broken balls/test balls | 5/5 | 3/5 | 2/5 | 2/5 | 5/5 | 5/5 | 5/5 |
| Average of strikes at breakage (300 strikes at maximum) | 260 | 260 | 290 | 290 | 260 | 220 | 80 |
| Feel @ 23° C. | | | | | | | |
| Putter | S | VS | VS | VS | H | H | VS |
| Iron | S | S | VS | VS | H | H | VS |
| Driver | S | S | VS | VS | AV | AV | VS |
| Feel @ 3° C. | | | | | | | |
| Putter | AV | S | S | S | H | H | VS |
| Iron | AV | AV | S | S | H | H | VS |
| Driver | AV | AV | S | S | H | AV | VS |

As seen from Tables 2 and 3, the three and two-piece golf balls of Examples 1–4 and 6 in which an appropriate amount of silicone rubber powder, silicone resin powder or composite silicone powder was added to the outer layer ionomer resin were superior in rebound and flight performance to the two-piece golf ball of Comparative Example 5 and even the three-piece golf balls of Comparative Examples 1 and 2 in which such powder was not added.

The balls within the scope of the invention were also improved in low-temperature performance factors including rebound (as represented by the slope of a temperature-initial velocity correlation line), flight distance and feel, and durability against consecutive strikes. They were far superior to the three-piece golf ball of Comparative Example 3 in which crosslinked diene rubber powder was added to the outer layer (cover) and the three-piece golf ball of Comparative Example 3 in which the carboxyl group-modified acrylic monomer polymer was added to the outer layer (cover), which were contemplated in the past. The golf balls of Comparative Example 7 in which millable type silicone rubber was used in the intermediate layer and Comparative Example 6 in which the core had millable type silicone rubber and polybutadiene co-cured showed short flight distances because of insufficient rebound and very poor durability against consecutive strikes.

Similar molding and ball performance advantages were found with the ball of Example 5 in which silicone rubber powder was added to the thermoplastic polyester elastomer in the intermediate layer and the ball of Example 7 in which silicone rubber powder was added to the core rubber.

The golf balls of the invention have the advantage of easy removal from a mold after molding, remain durable against consecutive strikes, and provide a satisfactory feel and rebound even at low temperature.

Japanese Patent Application No. 11-361060 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A golf ball having at least two pieces comprising:

an outermost cover portion formed of a composition based on at least one of primary resins selected from one group consisting of an ethylene ionomer resin, polyester elastomer, polyurethane elastomer, polyolefin elastomer, polyamide elastomer, polyolefin resin, and styrene block copolymer which has blended and uniformly dispersed therein at least one of a silicone rubber powder and a silicone resin powder, wherein the at least one of the silicone rubber powder and the silicone resin powder have a particle size of 0.5 to 15 μm.

2. The golf ball of claim 1 wherein the silicone rubber powder comprises crosslinked dimethylpolysiloxane or methylphenylpolysiloxane microparticulates or both.

3. The golf ball of claim 1 wherein the silicone resin powder comprises cured polyorganosilsesquioxane microparticulates.

4. The golf ball of claim 1 wherein the at least one of the silicone rubber powder and silicone resin powder have a particle size distribution ranging from 0.1 to 100 μm.

5. The golf ball of claim 1 wherein the silicone rubber powder and silicone resin powder are blended in an amount of 0.5 to 50% by weight of the composition.

6. The golf ball of claim 1 wherein the silicone rubber powder and silicone resin powder comprise spherical particles.

7. The golf ball of claim 1 wherein the silicone rubber powder and silicone resin powder have functional groups.

8. The golf ball of claim 1 wherein the golf ball-forming composition is at least one of a one-piece golf ball material, a core material and a cover material for a two-piece golf ball, a core material, an intermediate layer material and a cover material for a multi-piece golf ball having at least three pieces.

9. The golf ball of claim 1 wherein the golf ball-forming composition is based on at least one of an ethylene ionomer resin, polyurethane elastomer, polyolefin elastomer, polyamide elastomer, polyolefin resin, and styrene block copolymer.

10. The golf ball of claim 9 wherein the ethylene ionomer resin is an ethylene-(meth)acrylic acid copolymer neutralized with a monovalent or divalent metal ion or both or an ethylene-(meth)acrylic acid-(meth)acrylate terpolymer neutralized with a metal ion.

11. The golf ball of claim 9 wherein the ethylene ionomer resin has a Shore D hardness of 40 to 80 and a (meth)acrylic acid content of 5 to 25% by weight.

12. The golf ball of claim 1, wherein the powder has various particle size distributions ranging from 0.1 μm to 100 μm.

13. The golf ball of claim 1, wherein the at least one of the silicone rubber powder and silicone resin powder have a particle size of 0.5 to 6 μm.

14. The golf ball of claim 1, wherein the powder has various particle size distributions ranging from 0.1 to 30 μm.

15. The golf ball of claim 1, wherein the powder has various particle size distributions ranging from 0.1 to 15 μm.

16. The golf ball of claim 1, wherein the powder has various particle size distributions ranging from 0.1 to 10 μm.

* * * * *